US012654816B2

(12) United States Patent
Livingston

(10) Patent No.: US 12,654,816 B2
(45) Date of Patent: Jun. 16, 2026

(54) REVERSIBLE SEATING SYSTEM FOR A WATERBORNE VESSELS

(71) Applicant: John Livingston, Seattle, WA (US)

(72) Inventor: John Livingston, Seattle, WA (US)

( * ) Notice: Subject to any disclaimer, the term of this patent is extended or adjusted under 35 U.S.C. 154(b) by 780 days.

(21) Appl. No.: 18/049,867

(22) Filed: Oct. 26, 2022

(65) Prior Publication Data

US 2023/0144175 A1 May 11, 2023

Related U.S. Application Data

(60) Provisional application No. 63/272,160, filed on Oct. 26, 2021.

(51) Int. Cl.
*B63B 29/04* (2006.01)

(52) U.S. Cl.
CPC ..... *B63B 29/04* (2013.01); *B63B 2029/043* (2013.01)

(58) Field of Classification Search
CPC ..... B63B 29/04; B63B 2029/043
See application file for complete search history.

(56) References Cited

U.S. PATENT DOCUMENTS 3,743,350 A * 7/1973 Allen ..... A47C 17/1756 5/47
4,099,768 A * 7/1978 Amos ..... A47C 1/026 297/63
4,544,199 A * 10/1985 Wrigley ..... B63B 29/04 297/63
5,514,020 A * 5/1996 Gainforth ..... B63B 29/04 441/80
6,230,648 B1 * 5/2001 Davidson ..... B63B 35/14 114/363
7,775,597 B2 * 8/2010 Barzen ..... B60N 2/305 297/332
9,073,608 B1 * 7/2015 Foss ..... B60N 2/203
9,701,368 B2 * 7/2017 Neese ..... B63B 29/04
9,821,887 B1 * 11/2017 Wilson ..... B63B 29/04
10,494,061 B2 * 12/2019 Fafard ..... B63B 29/04
10,933,774 B2 * 3/2021 Curts ..... B63B 29/04
11,731,740 B1 * 8/2023 Hamilton, Sr. ..... B63B 29/06 114/363
12,128,992 B1 * 10/2024 Farrell ..... B63B 29/04
(Continued)

FOREIGN PATENT DOCUMENTS

ES 2811841 T3 * 3/2021 ..... B60N 2/3011

*Primary Examiner* — Marc Q Jimenez
*Assistant Examiner* — Jovon E Hayes
(74) *Attorney, Agent, or Firm* — Fox Rothschild LLP

(57) ABSTRACT

Seating systems for a waterborne vessels include first and second platforms that rotate in relation to each other, and in relation to the vessel. The systems are configurable in a first, second, and third position. In the first position of the system, the first platform has a substantially horizontal orientation and acts as a seating area, the second platform is upright and acts as a backrest, and the seated user faces a first direction. In the second position of the system, the second platform has a substantially horizontal orientation and acts as the seating area, the first platform is upright and acts as a backrest, and the seated user faces a second direction opposite the first direction. In the third position, the first and second platforms assume a relatively compact vertical orientation.

16 Claims, 13 Drawing Sheets

(56) References Cited

U.S. PATENT DOCUMENTS

2005/0247255 A1* 11/2005 Huse ..... A47C 17/161
114/363
2009/0277372 A1* 11/2009 Wood ..... B63B 29/04
297/94

* cited by examiner

SECTION A-A

SECTION C-C

REVERSIBLE SEATING SYSTEM FOR A WATERBORNE VESSELS

CROSS-REFERENCE TO RELATED APPLICATIONS

This application claims the benefit under 35 U.S.C. § 119 (e) of U.S. Provisional Application No. 63/272,160 filed Oct. 26, 2021, the contents of which are incorporated by reference herein their entirety.

BACKGROUND

Waterborne vessels, such as small and medium-sized boats used for recreational purposes, typically are equipped with seating for multiple passengers. The passengers often prefer to sit facing different directions, depending on the manner in which the vessel is being operated. For example, passengers may prefer to sit in a forward-facing direction while the vessel is moving. The passengers may prefer to sit in a rearward-facing direction at other times. For example, passengers may prefer to sit facing rearward, toward a swim platform located at the stern of the vessel, when the vessel is anchored and swimmers are entering and exiting the water via the swim platform.

Space within waterborne vessels often is limited. Thus, it be challenging for the vessel manufacturer to provide sufficient passenger seating, and to provide seating arrangements that satisfy passenger preferences under all of the various conditions in which such vessels normally operate.

SUMMARY

In one aspect of the disclosed technology, a seating system for a vessel includes a first platform, and a second platform coupled to the first platform and configured to rotate in relation to the first platform. The seating system is configured to move between a first and a second position. The second platform has a substantially horizontal orientation and the first platform is substantially upright when the seating system is in the first position. The first platform has a substantially horizontal orientation and the second platform is substantially upright when the seating system is in the second position.

In another aspect of the disclosed technology, the system further includes a mount configured to be mounted on the waterborne vessel; and a hinge. The hinge includes a first arm mounted on the first platform, and a second arm mounted on the second platform. The second arm is coupled to the first arm and is configured to rotate in relation to the first arm. The second arm is configured to engage and rotate in relation to the mount when the seating system is in the first position. The first arm is configured to engage and rotate in relation to the mount when the seating system is in the second position.

In another aspect of the disclosed technology, the first arm is further configured to be disengaged from the mount when the seating system is in the first position; and the second arm is further configured to be disengaged from the mount when the seating system is in the second position.

In another aspect of the disclosed technology, the system further includes a first pin mounted on the first arm and configured to be received in a first groove formed in the mount when the seating system is in the second position; and a second pin mounted on the second arm and configured to be received in a second groove formed in the mount when the seating system is in the first position.

In another aspect of the disclosed technology, the first arm is further configured to engage and rotate in relation to the mount by way of the first pin; and the second arm is further configured to engage and rotate in relation to the mount by way of the second pin.

In another aspect of the disclosed technology, the seating system is further configured to move between the first position, the second position, and a third position; and the first and second platforms each have a substantially vertical orientation when the seating system is in the third position. The first pin is further configured to be received in the first groove when the seating system is in the third position; and the second pin is further configured to be received in the second groove when the seating system is in the third position.

In another aspect of the disclosed technology, the system further incudes a third bracket coupled to the first and second brackets and the mount. The third bracket is configured to rotate in relation the first and second brackets and the mount, and is further configured to limit a range of rotation of the first and second brackets in relation to the mount.

In another aspect of the disclosed technology, the third bracket includes a first member, and a second member coupled to the first member and configured to translate linearly in relation to the first member.

In another aspect of the disclosed technology, the system further includes a third pin mounted on the first arm and configured to be received in the first groove when the seating system is in the second position; and a fourth pin mounted on the second arm and configured to be received in the second groove when the seating system is in the first position.

In another aspect of the disclosed technology, the first platform is configured to form a backrest and the second platform is configured to form a seating area when the seating system is in the first position; and the second platform is configured to form another backrest and the first platform is configured to form another seating area when the seating system is in the second position.

In another aspect of the disclosed technology, the backrest formed by the first platform faces a first direction, and the backrest formed by the second platform faces a second direction substantially opposite the second direction.

In another aspect of the disclosed technology, the first and second platforms each includes a frame, and padding mounted on the frame.

In another aspect of the disclosed technology, the first pin is located proximate a first end of the first arm; and the second pin is located proximate a first end of the second arm. The second arm is coupled to the first arm at a location on the second arm proximate a second end of the second arm, and at a location on the first arm proximate a second end of the first arm.

In another aspect of the disclosed technology, the system further includes a restraint having a flexible member configured to carry a tension force. A first end of the flexible member is securely attached to the first platform; a second end of the flexible member is securely attached to the second platform; and the flexible member is configured to limit a range of rotation of the second platform in relation to the first platform.

In another aspect of the disclosed technology, the restraint further incudes a rigid member configured to support the flexible member, and to further limit the range of rotation of the second platform in relation to the first platform when the seating system is in the first and second positions of the seating system.

In another aspect of the disclosed technology, the hinge is a first hinge; and the system further incudes a second hinge. The first arm of the first hinge is mounted on a first side of the first platform; and the second arm of the first hinge is mounted on a first side of the second platform. The first arm of the second hinge is mounted on a second side of the first platform; and the second arm of the second hinge is mounted on a second side of the second platform.

In another aspect of the disclosed technology, at least one of the first and second arms has a slot formed therein; and at least one of the first and second arms includes a pin configured to be received in the slot of the other of the first and second arms. The pin is further configured to guide the first and second arms during relative movement of the first and second arms, and to limit a range of rotation of the first and second arms in relation to each other.

In another aspect of the disclosed technology, a method for deploying a reversible seating system for a vessel includes providing a first platform, and a second platform coupled to and configured to rotate in relation to the first platform. The method also includes providing a hinge having a first arm connected to the first platform, and a second arm connected to the second platform. The second arm is coupled to and is configured to rotate in relation to the first arm.

The method also includes providing a mount configured to be mounted on the vessel; and engaging the first and second arms with the mount while the first and second platforms are in a substantially vertical orientation so that the mount restrains the first and second arms and the first and second platforms from rotating in relation to the mount.

In another aspect of the disclosed technology, the method further includes lifting the first platform to disengage the first arm from the mount; and rotating the first and second platforms in relation to the mount in a first angular direction while the second arm remains engaged with the mount, so that the first and second platforms each assume a substantially horizontal orientation. The method also includes rotating the first platform in relation to the second platform so that the first platform assumes an upright orientation and faces a first direction.

In another aspect of the disclosed technology, the method further includes lifting the second platform to disengage the second arm from the mount; and rotating the first and second platforms in relation to the mount in a second angular direction opposite the first angular direction while the first arm remains engaged with the mount, so that the first and second platforms each assume a substantially horizontal orientation. The method further incudes rotating the second platform in relation to the first platform so that the second platform assumes an upright orientation and faces a second direction substantially opposite the first direction.

DESCRIPTION OF THE DRAWINGS

The accompanying drawings, which are incorporated herein and constitute part of this specification, are illustrative of particular embodiments of the present disclosure and do not limit the scope of the present disclosure. The drawings are not to scale and are intended for use in conjunction with the explanations in the following detailed description.

DETAILED DESCRIPTION

Figure 1:
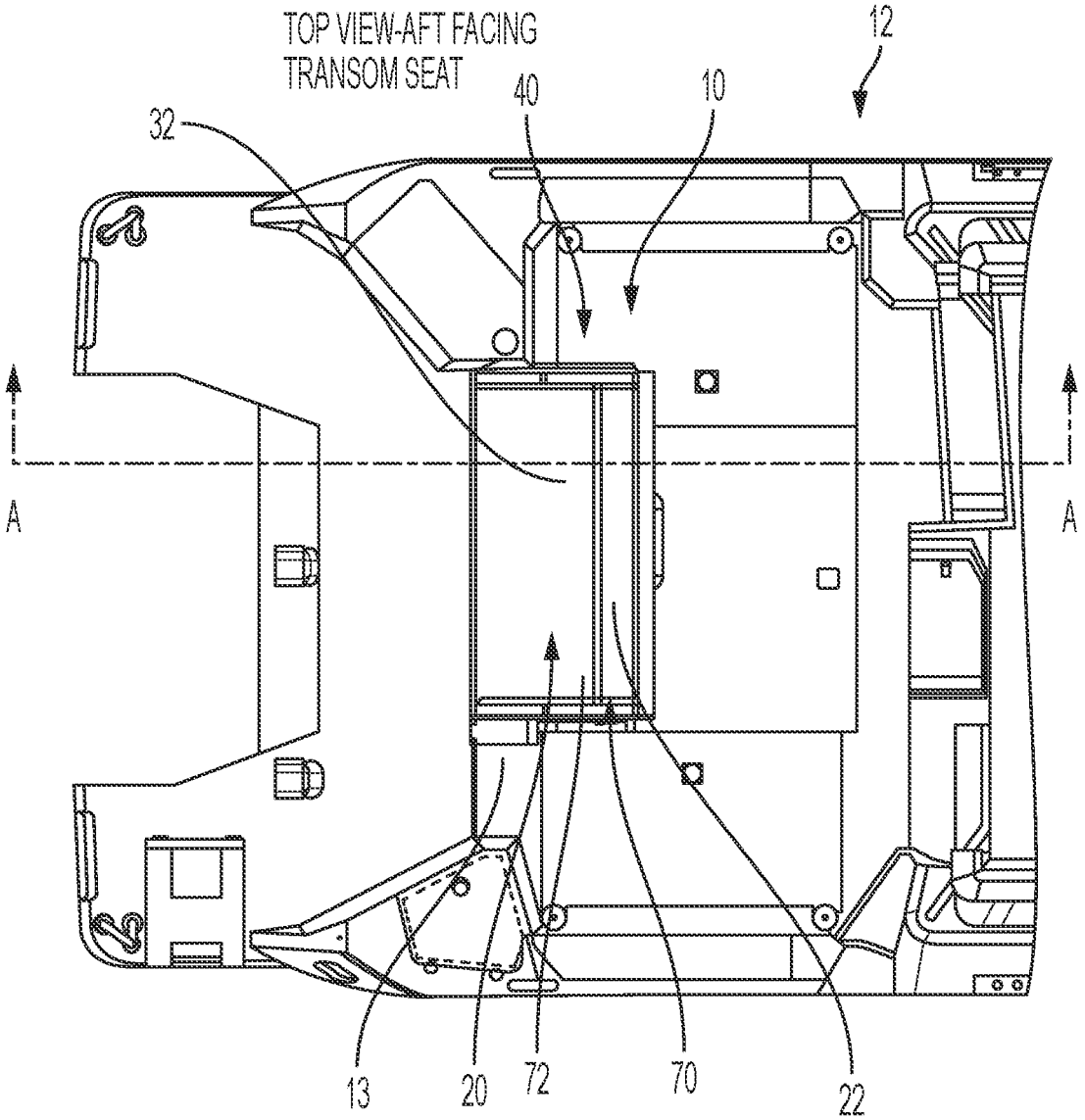
FIG. 1 is a top view of a seating system installed on a waterborne vessel, depicting the seating system in a second, or rearward-facing position.

The following discussion omits or only briefly describes conventional features of the disclosed technology that are apparent to those skilled in the art. It is noted that various embodiments are described in detail with reference to the drawings, in which like reference numerals represent like parts and assemblies throughout the several views. Reference to various embodiments does not limit the scope of the claims appended hereto. Additionally, any examples set forth in this specification are intended to be non-limiting and merely set forth some of the many possible embodiments for the appended claims. Further, particular features described herein can be used in combination with other described features in each of the various possible combinations and permutations.

The figures depict a seating system 10 for a waterborne vessel 12. In the illustrative embodiment disclosed herein, the seating system 10 is located along the transom 13 of the vessel 12. The installation of the seating system 10 at this location on the vessel 12 is disclosed for illustrative purposes only. The seating system 10 can be installed at other locations on the vessel 12, e.g., on the bridge of the vessel 12. Also, the seating system 10 can be installed in orientations other than the front-to-back orientation disclosed herein. For example, the seating system 10 can be installed in a sideways-facing direction.

Figure 2:
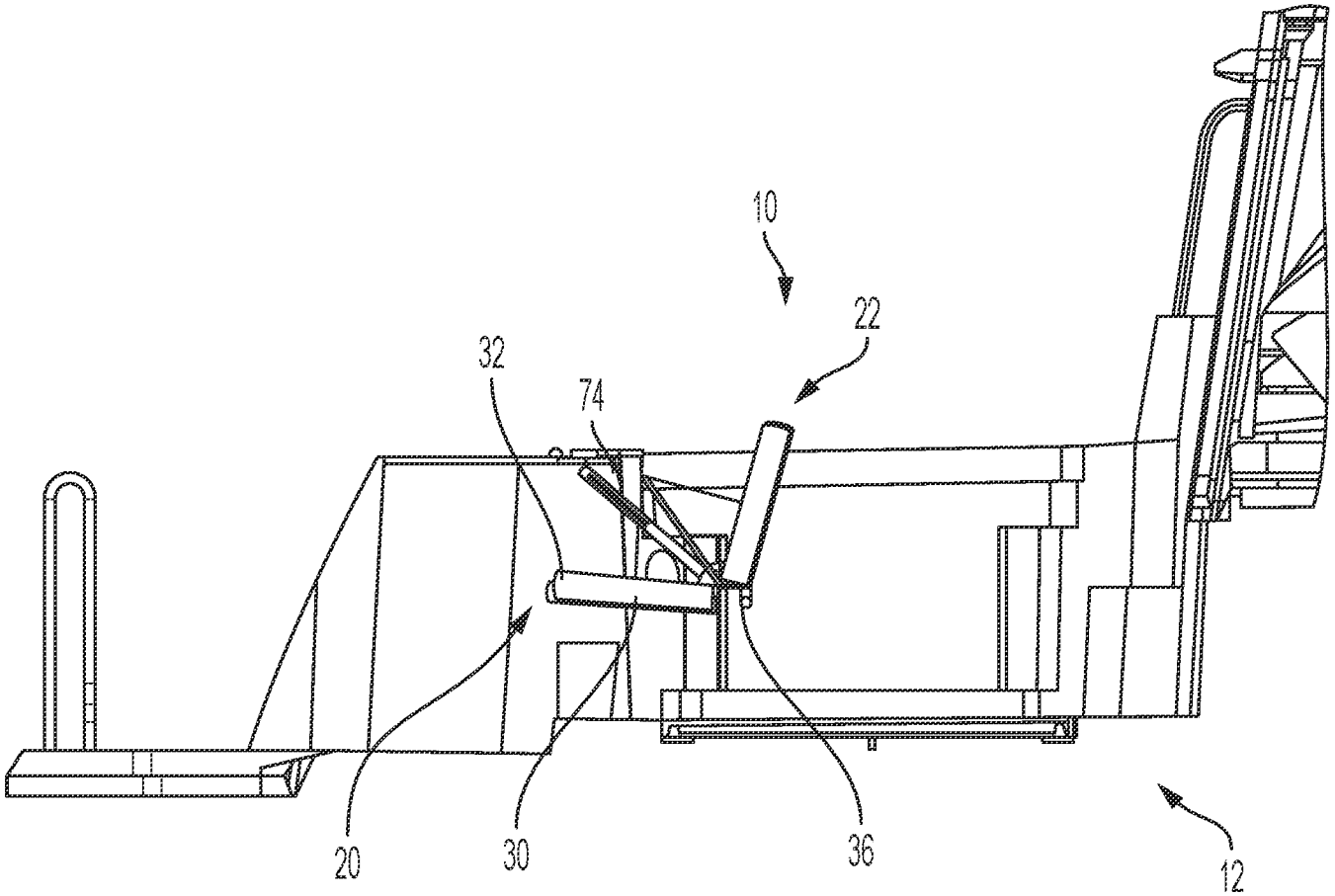
FIG. 2 is a cross-sectional side view of the seating system and the waterborne vessel shown in FIG. 1, taken through the line "A-A" if FIG. 1, depicting the system in the rearward-facing position.
Figure 3:
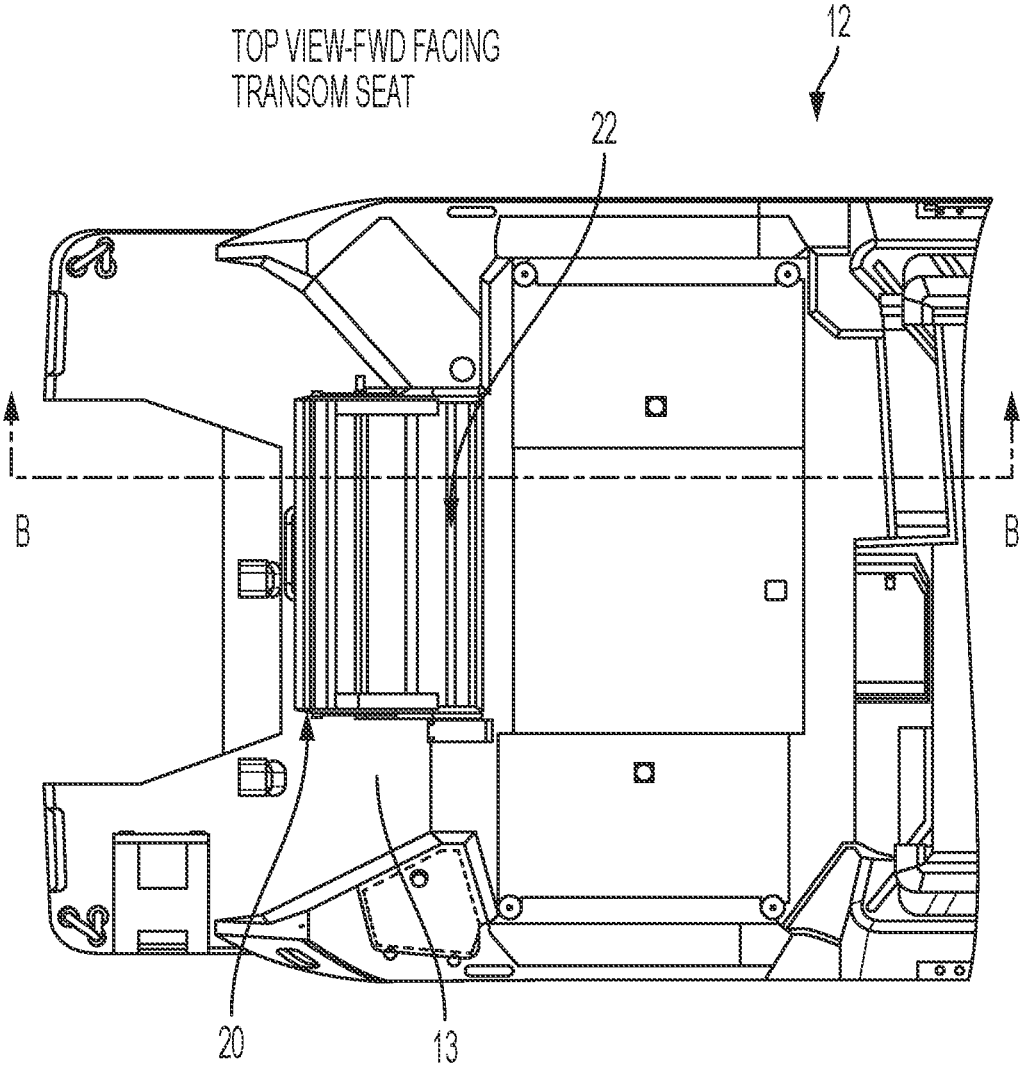
FIG. 3 is a top view of the seating system and the waterborne vessel shown in FIGS. 1 and 2, depicting the seating system in a first, or forward-facing position.
Figure 4:
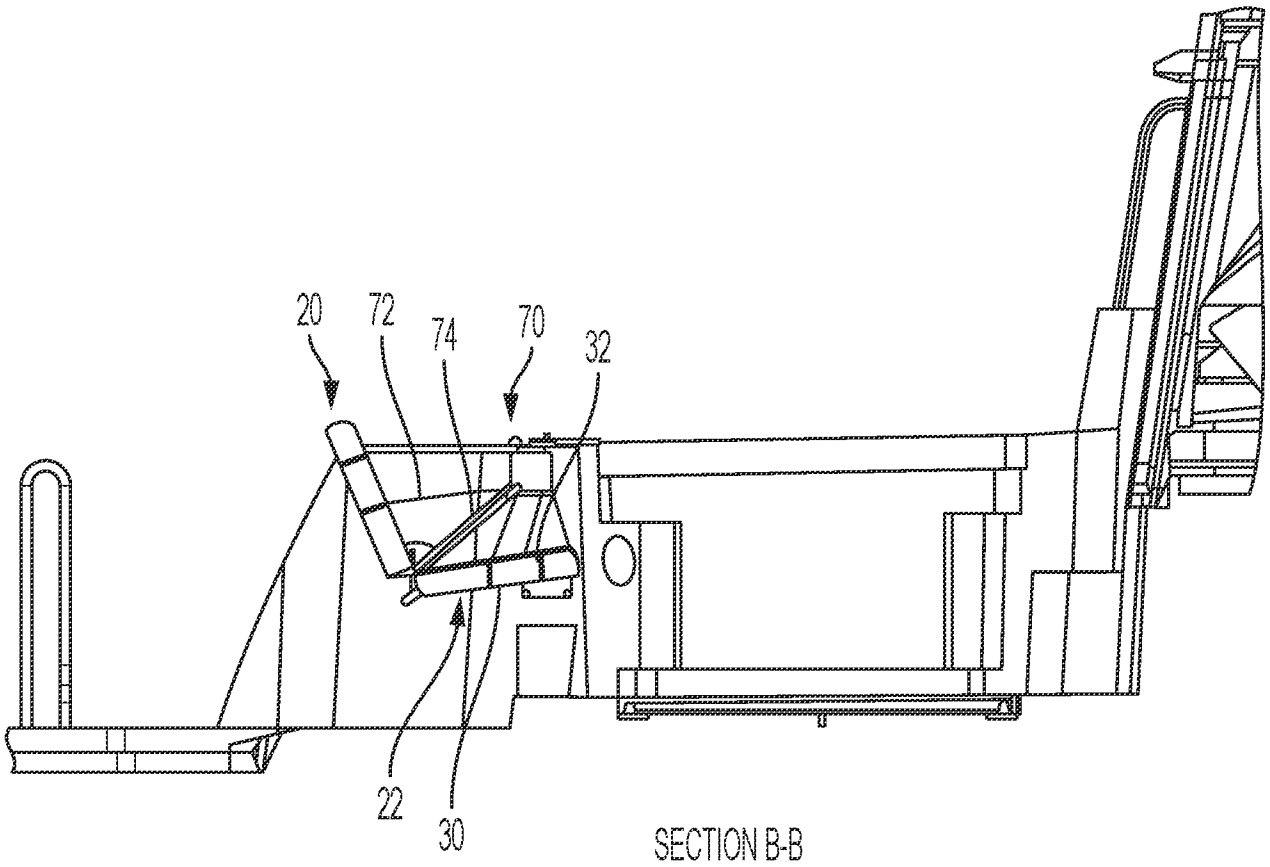
FIG. 4 is a cross-sectional side view of the seating system and the waterborne vessel shown in FIGS. 1-3, taken through the line "B-B" if FIG. 3, depicting the system in the forward-facing position.
Figure 5:
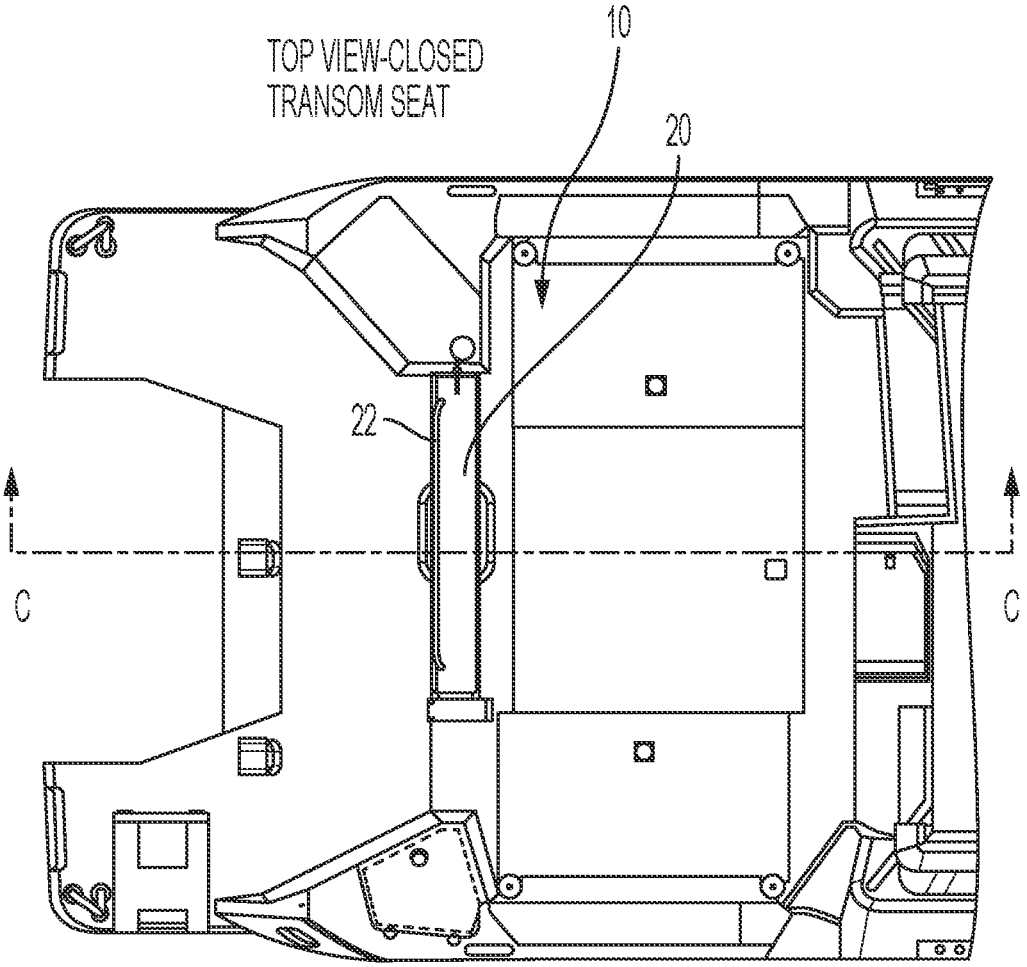
FIG. 5 is a top view of the seating system and the waterborne vessel shown in FIGS. 1-4, depicting the seating system in a stored position.
Figure 9:
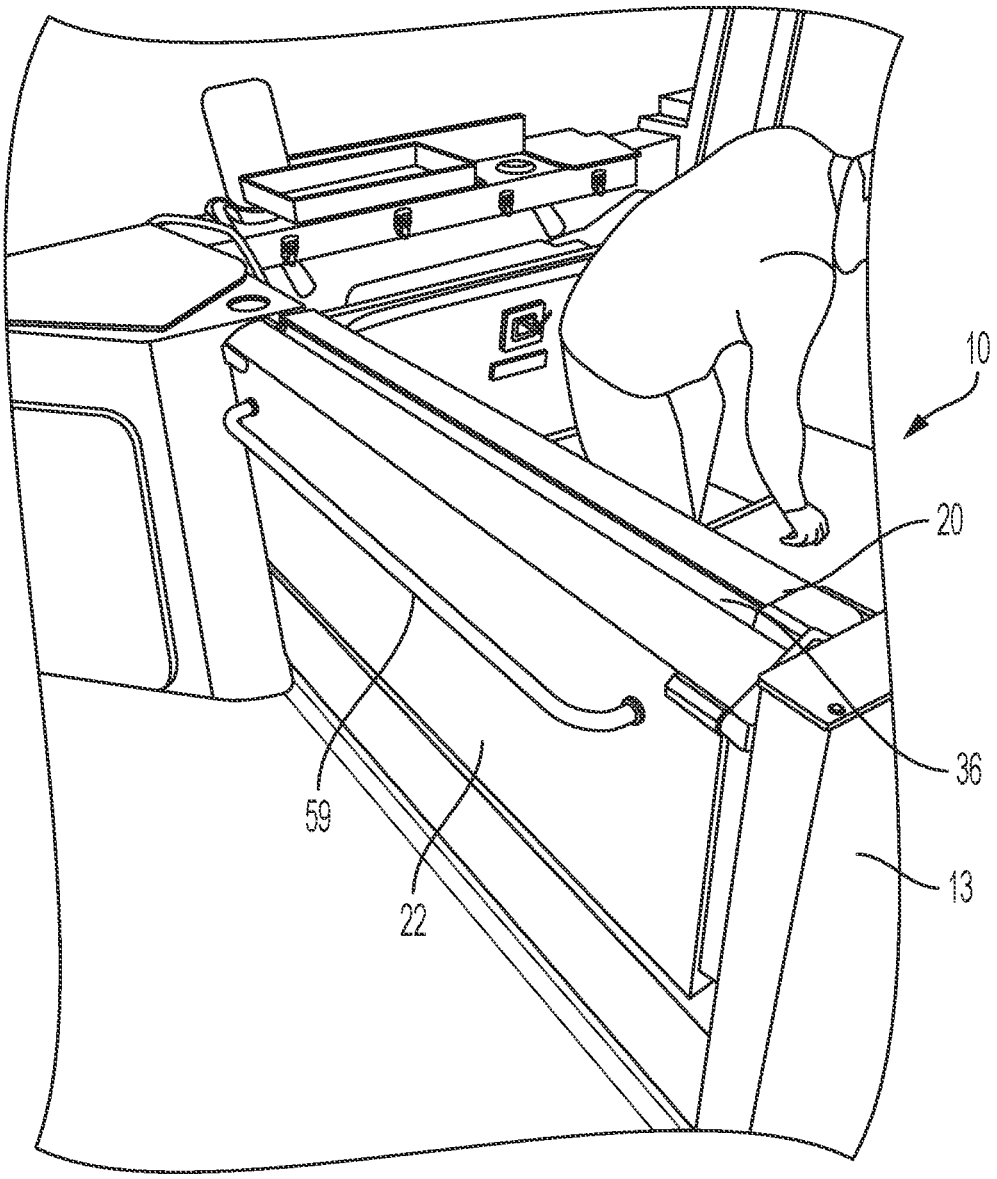
FIG. 9 is a top-rear perspective view of the seating system and the waterborne vessel shown in FIGS. 1-6, depicting the seating system in the stored position.
Figure 10:
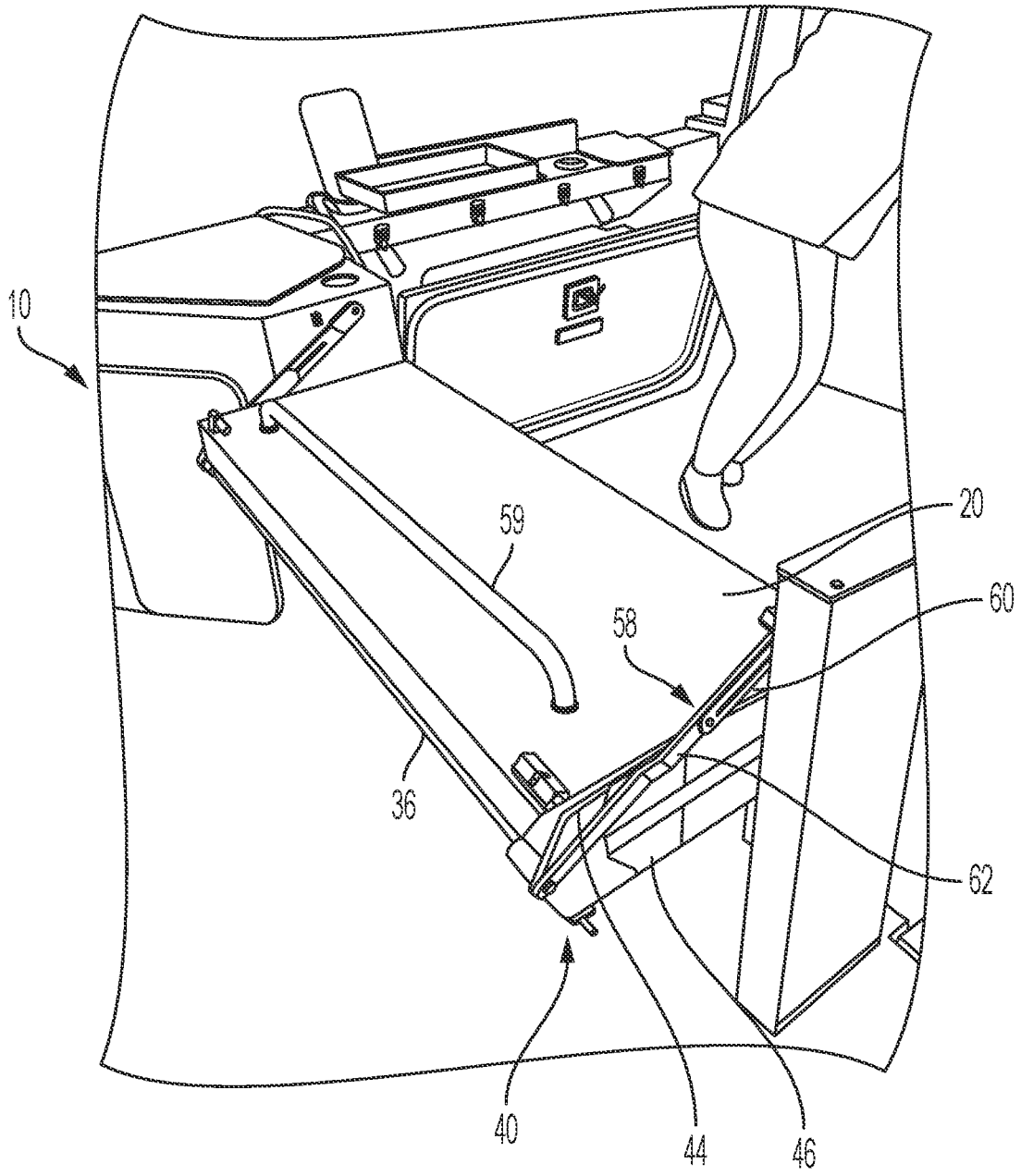
FIG. 10 is a top-rear perspective view of the seating system and the waterborne vessel shown in FIGS. 1-6, depicting the seating system in an intermediate position between the stored position and forward-facing position.
Figure 11:
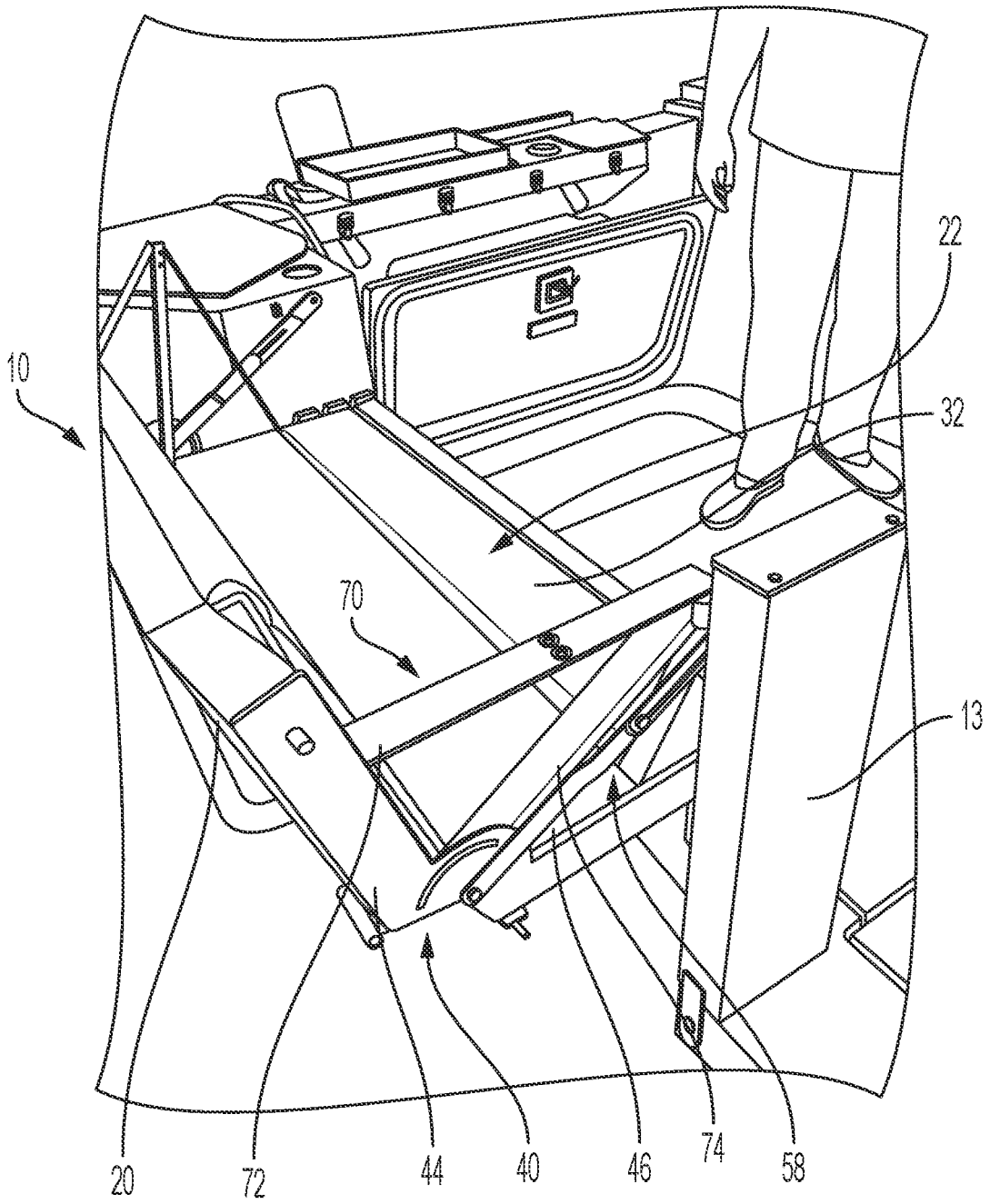
FIG. 11 is a top-rear perspective view of the seating system and the waterborne vessel shown in FIGS. 1-6 and 10, depicting the seating system the forward-facing position.
Figure 12:
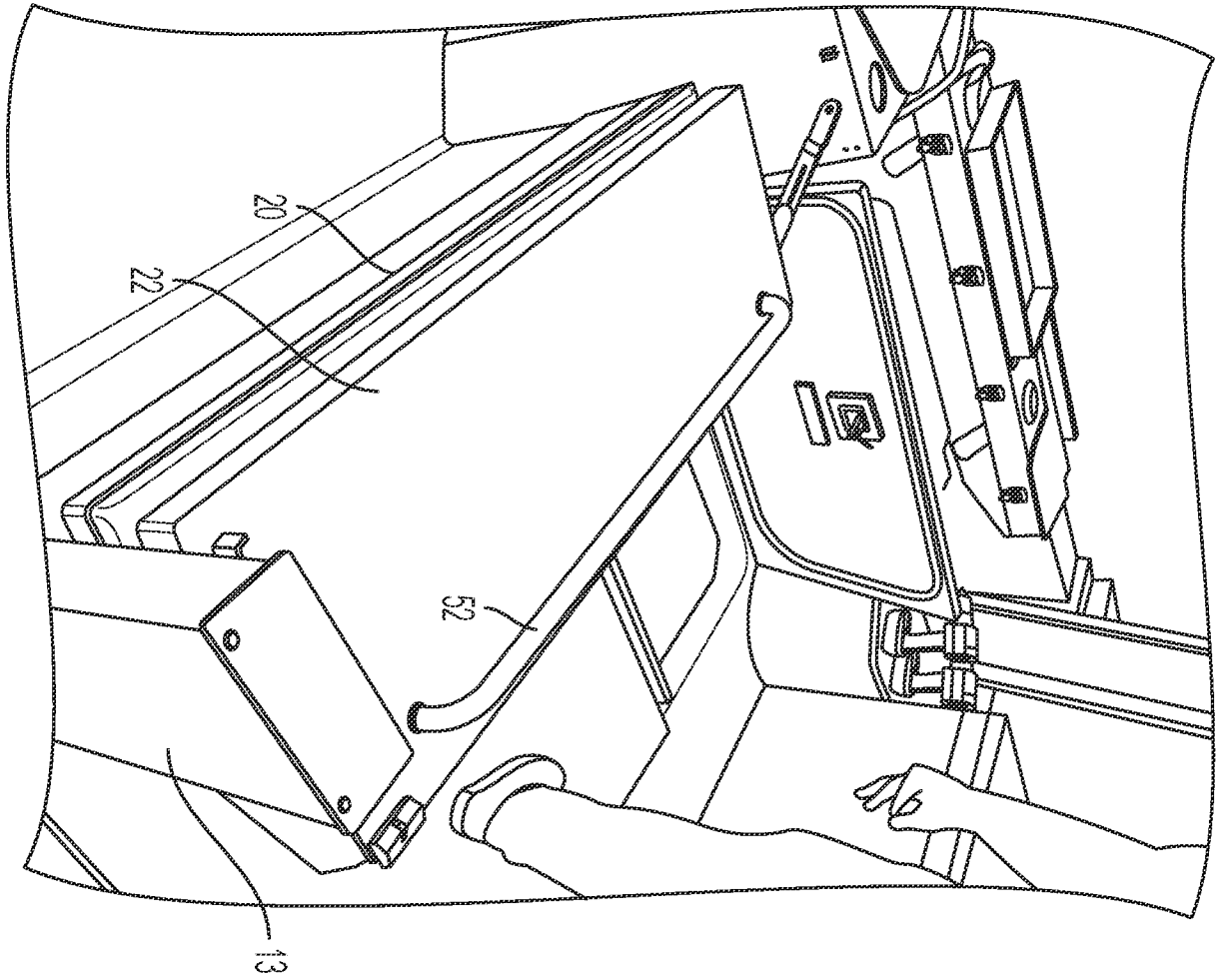
FIG. 12 is a top-rear perspective view of the seating system and the waterborne vessel shown in FIGS. 1-6, 10, and 11, depicting the seating system in an intermediate position between the stored position and rearward-facing position.
Figure 13:
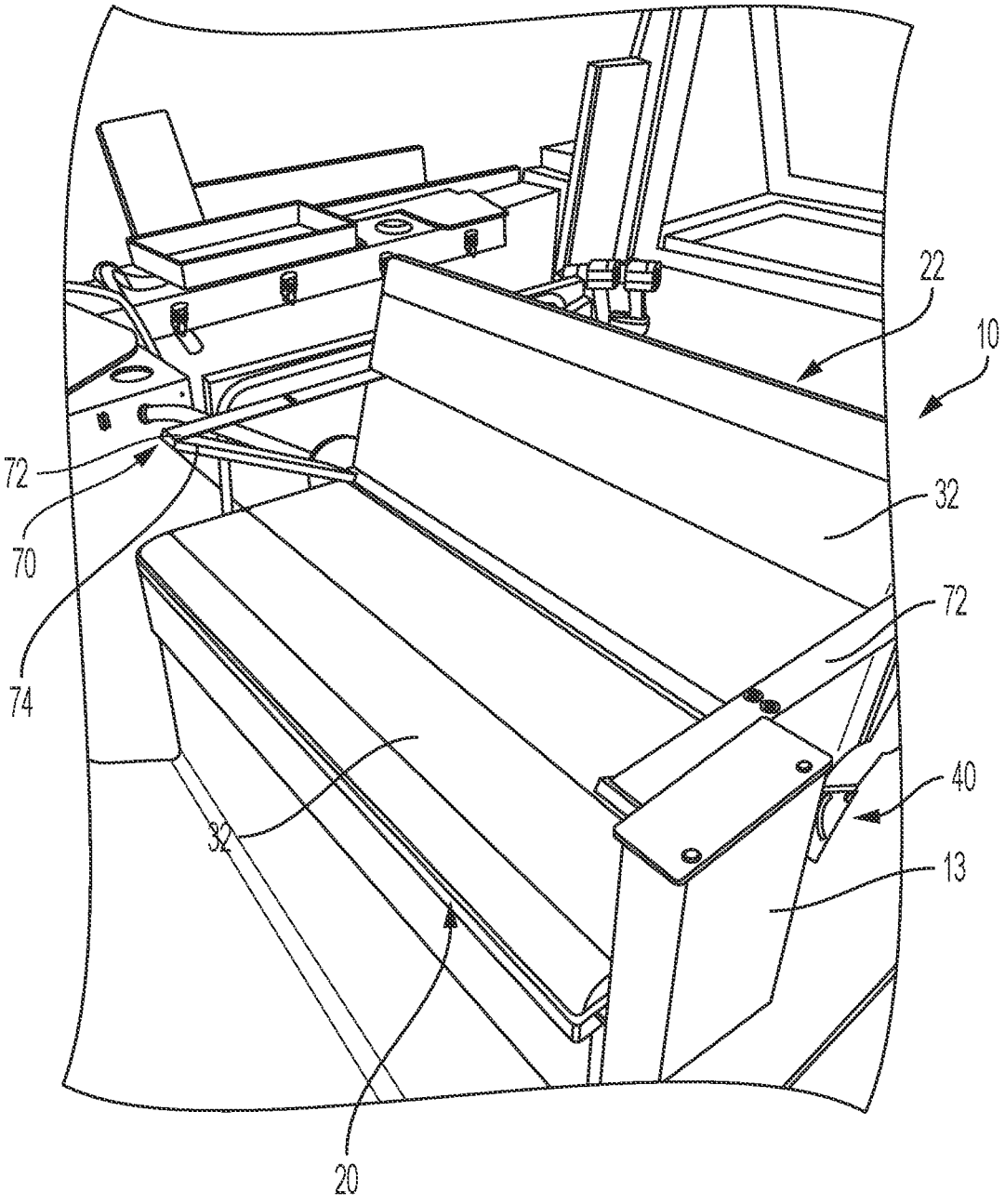
FIG. 13 is a top-rear perspective view of the seating system and the waterborne vessel shown in FIGS. 1-6 and 10-12, depicting the seating system in the rearward-facing position.

The seating system 10 is configured to open, or deploy, in two ways, e.g., in a first or forward-facing position, shown in FIGS. 3, 4, and 11; and a second or rearward-facing direction, shown in FIGS. 1, 2, and 13. Also, the seating system 10 can be configured in a third or stored position, shown in FIGS. 5, 6, and 9. The seating system 10 has a relatively small footprint when in the stored position. For example, in the illustrative embodiment disclosed herein, the seating system 10 requires only about eight inches of floor space on the vessel 12 when the seating system 10 is in its stored position.

The seating system 10 comprises a first elongated member or platform 20, and a second elongated member or platform 22. When the seating system 10 is configured in the first or forward-facing position, the second platform 22 has a substantially horizontal orientation, and the first platform 20 has an upright, slightly inclined orientation. In this configuration of the seating system 10, the second platform 22 provides the surface on which the user sits; and the first platform 20 acts as a back support against which the user can recline. As can be seen in FIGS. 3 and 4, the second platform 22 is located forward of the first platform 20, the second platform 22 extends into the cockpit of the vessel 12 and the user faces forward, i.e., toward the cockpit and the bow of the vessel 12, when seated.

When the seating system 10 is configured in the second or rearward-facing position, the second platform 22 has an upright, slightly inclined orientation and the first platform 20 has a substantially horizontal orientation. In this configuration of the seating system 10, the first platform 20 provides the surface on which the user sits; and the second platform 22 acts as the back support against which the user can recline. As can be seen in FIGS. 1 and 2, because the first platform 20 is located rearward of the second platform 22 when the seating system 10 is configured in this manner, the first platform 20 extends over the transom 13 of the vessel 12 and the user faces rearward, i.e., toward the swim platform and the stern of the vessel 10, when seated.

The first and second platforms 20, 22 each include a rigid frame 30, and padding 32 mounted on the frame 30. The seating system 10 is configured so that the user sits on the padding 32 of the second platform 20, and rests his or her back on the padding 32 of the first platform 20, when the seating system 10 is in the forward-facing position. The seating system 10 is configured so that the user sits on the padding of the first platform 20, and rests his or her back on the padding of the second platform 22, when the seating system 10 is in the rearward-facing position. The frames 30 are coupled to each other by a hinge bracket 36 that facilitates relative rotation between the first and second platforms 20, 22. The hinge bracket 36 is denoted in FIG. 2.

Figure 7:
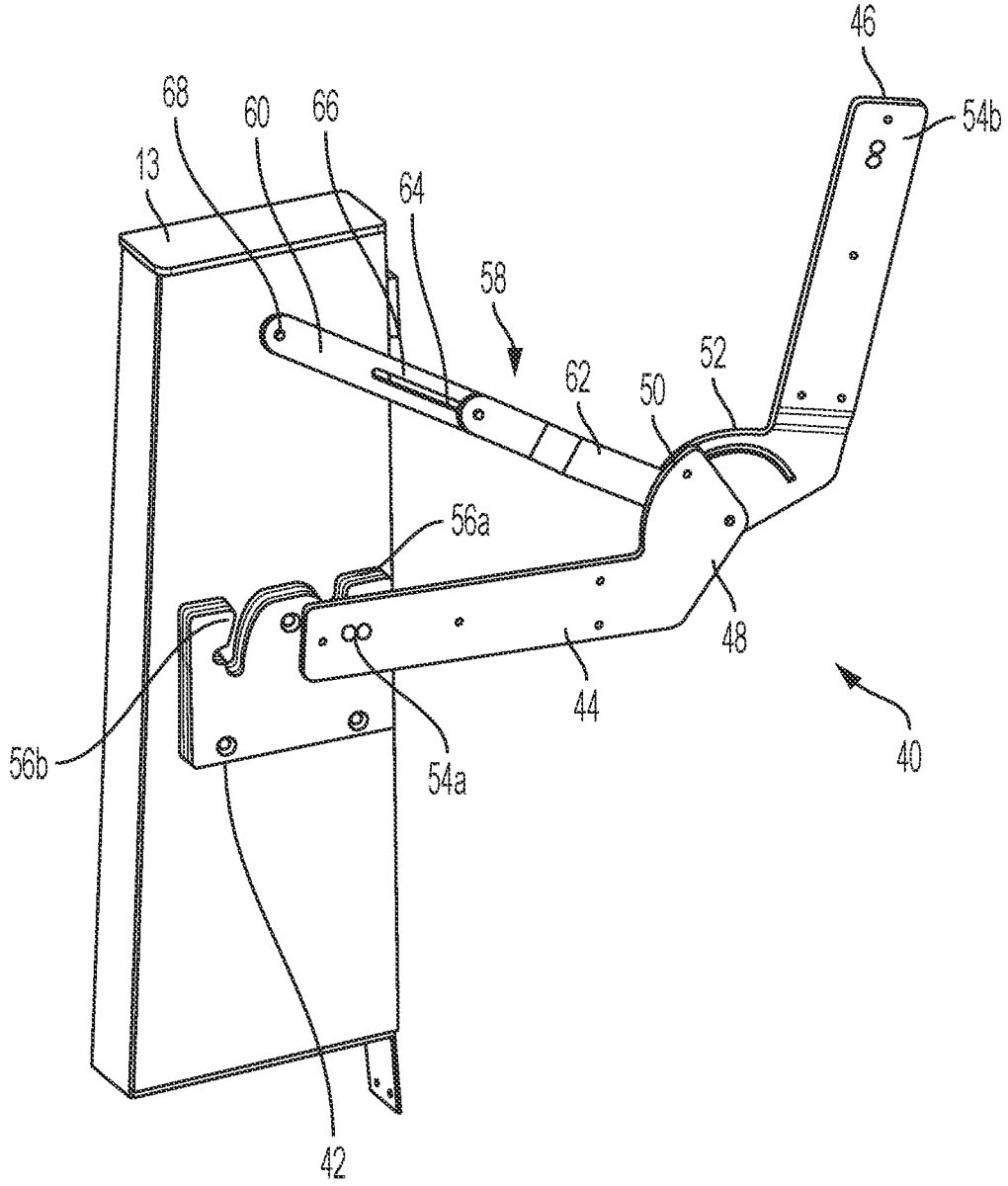
FIG. 7 is a top-side perspective view of a hinge of the seating system shown in FIGS. 1-6, with the hinge in a configuration corresponding the forward-facing position of the seating system.
Figure 8:
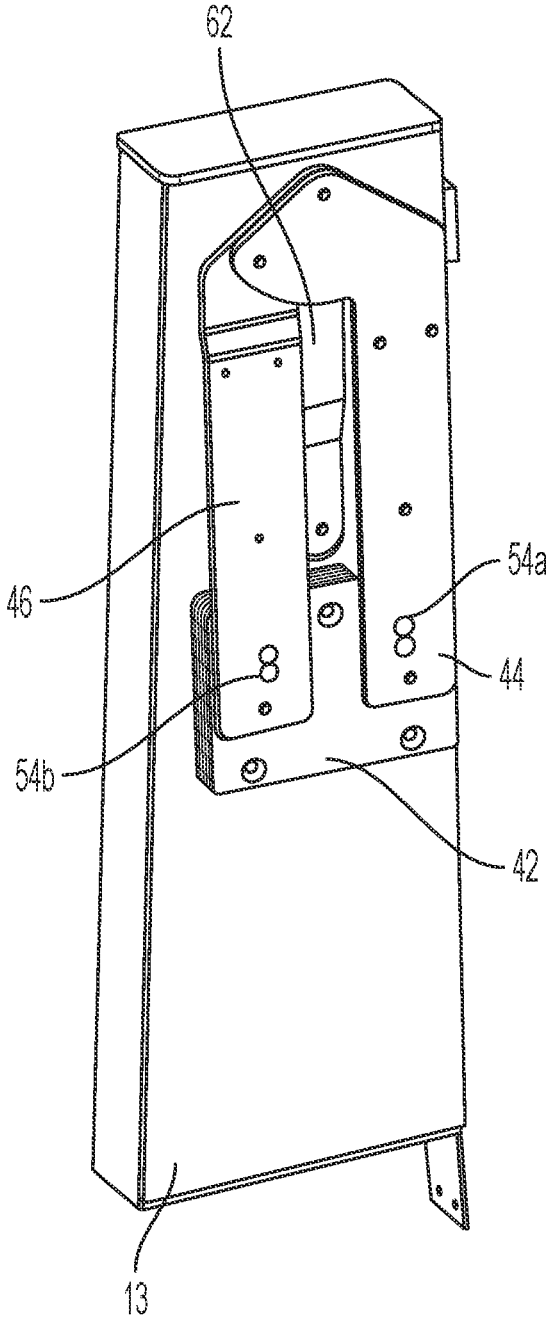
FIG. 8 is a top-side perspective view of a hinge shown in FIG. 7, with the hinge in a configuration corresponding the stored position of the seating system.

The seating system 10 also includes two hinges 40 that facilitate movement of the seating system 10 between the forward-facing, rearward-facing, and stored positions. The hinges 40 are mounted on opposite sides of the first and second platforms 20, 22. One of the hinges 40 is depicted in FIGS. 7 and 8. FIG. 7 shows the hinge 40 when the seating system 10 is in the rearward-facing configuration. FIG. 8 shows the hinge 40 when the seating system 10 is in the stored configuration.

The system 10 also include two mounts 42, depicted in FIGS. 7 and 8. The mounts 42 are securely mounted on opposite sides of the transom 13 of the vessel 12, so that the mounts 42 face inward, toward each other.

Each hinge 40 includes an elongated first bracket 44, and an elongated second bracket 46. A first end of the first bracket 44 is coupled to a first end of the second bracket 46 by a first pin 48 or other suitable means that permits relative rotation between the first bracket 44 and the second bracket 46.

A second pin 50 is securely mounted on the first bracket 44, proximate the first pin 48. The second pin 50 is received in a slot 52 in the second bracket 46. The second pin 50 acts as a stop that limits the rotation of the second bracket 46 in relation to the first bracket 44.

The first bracket 44 of each hinge 40 is securely connected to an associated side of the frame 30 of the first platform 20. The second bracket 46 of each hinge 40 is securely connected to an associated side of the frame 30 of the second platform 22. The first and second brackets 44, 46 thus rotate in relation to each other about the first pin 48 as the first platform 20 rotates in relation to the second platform 22 about the hinge bracket 36.

Referring to FIGS. 7 and 8, two pins 54*a* are securely mounted on a second end of the first bracket 44. Two pins 54*b* likewise are securely mounted on a second end of the second bracket 46. The pins 54*a*, 54*b* are removably received in respective slots 56*a*, 56*b* in the mount 42. More specifically, the pins 54*a* are disposed in the slot 56*a* when the seating system 10 is in its stored and rearward-facing positions. The pins 54*b* are disposed in the slot 56*b* when the seating system 10 is in its stored and forward-facing positions.

Each hinge 40 also includes a third bracket in the form of an extension bracket 58. The extension bracket 58 comprises an elongated first member 60 and an elongated second member 62. The first and second members 60, 62 are coupled to each other by a pin 64 or other suitable means that facilitates relative rotation between the first and second members 60, 62. The pin 64 is securely mounted on a first end of the second member 62, and slides within a slot 66 in the first member 60 so that the first and second members 60, 62 can translate linearly in relation to each other. The pin 64 also acts as a stop that limits the linear movement of the second member 62 in relation to the first member 60. A second end of the second member 62 is coupled to the respective first ends of the first and second brackets 44, 46, by the first pin 48.

An end of the first member 60 is coupled to the transom 13 of the vessel 12 by a pin 68 or other suitable means that permits the first member 60 to rotate in relation to the transom 13.

Figure 6:
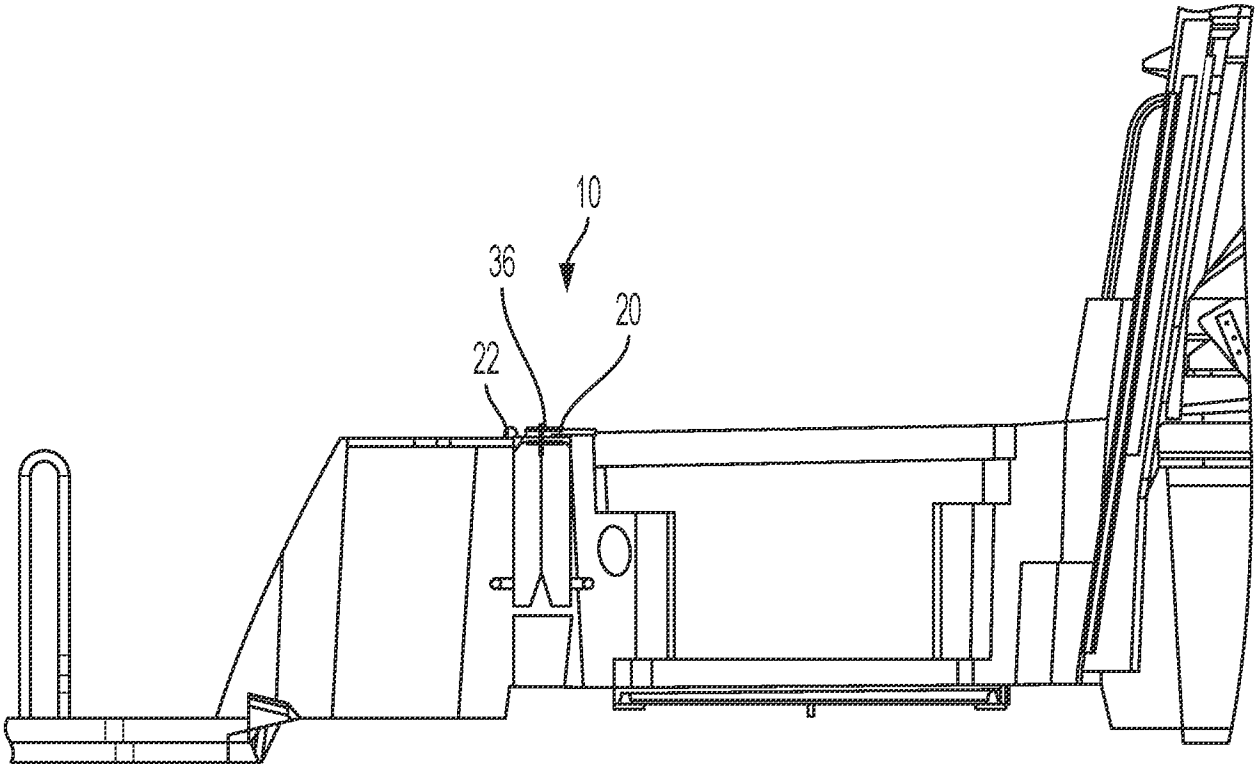
FIG. 6 is a cross-sectional side view of the seating system and the waterborne vessel shown in FIGS. 1-5, taken through the line "C-C" if FIG. 5, depicting the system in the stored position.

When the seating system 10 is in its stored position, the pins 54*a* located on the second end of the first bracket 44 of each hinge 40 are disposed in the slot 56*a* of the corresponding mount 42; and the pins 54*b* located on the second end of the second bracket 46 of each hinge 40 are disposed in the slot 56*b* of the corresponding mount 42, as shown in FIG. 8. Also, the first and second platforms 20, 22 are folded and have a substantially vertical orientation, so that the padding 32 of the first platform 20 faces and abuts the padding 32 of the second platform 22, as depicted in FIG. 6. The pins 54*a*, 54*b*, which are captured within the respective slots 56*a*, 56*b* of the mount 42, are supporting the first and second platforms 20, 22 and are restraining the first and second platforms 20, 22 from substantial movement in the forward and rearward directions, i.e., toward and away from the bow of the waterborne vessel. The interaction of the first and second pins 54*a*, 54*b* and the mount 42 also prevents the first and second platforms 20, 22 from rotating in relation to the transom 13, or in relation to each other. Also, the extension brackets 58 are not extended, i.e., the first and second members 60, 62 of each extension bracket 58 completely overlap, when the seating system 10 is in its stored position.

To place the seating system 10 in its forward-facing position from its stored position, the user lifts the first platform 20 so that the pins 54*a* rise out of their associated slots 56*a*. Once the pins 54*a* clear the slots 54*a*, the first and second platforms 20, 22 can rotate counterclockwise, from the perspective of FIG. 4, about the pins 54*b*, which remain in their associated slots 56*b*. Because the second end of the second member 62 of the extension bracket 58 of each hinge 40 is coupled to the first and second platforms 20, 22 by way of the first and second brackets 44, 46, the rotation of the first and second platforms 20, 22 draws the second member 62 away from the first member 60, causing the extension bracket 58 to extend.

The first and second platforms 20, 22 can be equipped with handles 59 through which the user can apply force to move the first and second platforms 20, 22. The handles 59 are visible FIGS. 9-12.

The continued counterclockwise rotation of the first and second platforms 20, 22 eventually causes the first and second platforms 20, 22 to undergo an angular displacement slightly over 90 degrees, to an orientation slightly inclined from the horizontal. At approximately this point, the pin 64 in the second member 62 of the extension bracket 58 reaches the end of its travel within the slot 66 of the first member 60, which in turn causes the extension bracket 58 to limit further counterclockwise rotation of the first and second platform 20, 22.

Once the second platform 22 has reach the end of its angular travel, the first platform 20 can be rotated in relation of the second platform 22 in the counterclockwise direction, from the perspective of FIG. 4, about the hinge bracket 36.

The seating system 10 further includes two restraints 70 located on opposite sides of the seating system 10. Each restraint 70 includes a flexible member configured to carry a tension force. The flexible member can be, for example, a cable or strap 72. Each restraint 70 also includes a rigid member in the form of, for example, a pole 74. A first end of each strap 72 is securely attached to the first platform 20, and a second end of each strap 72 is securely attached to the second platform 22. A first end of the pole 74 is secured to the hinge bracket 36. The strap 72 is attached to a second end of the pole 74, at the approximate mid-point of the strap 72. Each restraint 70 is configured so that its respective strap 72 becomes fully tensioned as the first platform 20 undergoes an angular displacement of slightly over 90 degrees in relation of the second platform 22, to an upright orientation slightly inclined from the vertical. The tensioned strap 72, supported at its midpoint by the corresponding pole 74, acts as a stop that prevents further counterclockwise rotation of the first platform 20 in relation to the second platform 22.

At this point, the seating system 10 is configured in its forward-facing configuration. The seating area is facing toward the cockpit of the vessel 12, with the second platform 22 providing a seating area for the user and the first platform 20 providing back support.

To place the seating system 10 in its rearward-facing configuration from the stored position, the user lifts the second platform 22 so that the pins 54*b* rise out of their associated slots 56*b*. Once the pins 54*b* clear the slots 54*b*, the first and second platforms 20, 22 can rotate clockwise, from the perspective of FIG. 2, about the pins 54*a*, which remain in their associated slots 56*a*. Because the second end of the second member 62 of the extension bracket 58 of each hinge 40 is coupled to the first and second platforms 20, 22 by way of the first and second brackets 44, 46, the rotation of the first and second platforms 20, 22 draws the second member 62 away from the first member 60, causing the extension brackets 58 to extend.

The continued clockwise rotation of the first and second platforms 20, 22 eventually causes the first and second platforms to undergo an angular displacement slightly over 90 degrees, to an upright orientation slightly inclined from the horizontal. At approximately this point, the pin 64 in the second member 62 of the extension bracket 58 reaches the end of its travel within the slot 66 of the first member 60, which in turn causes the extension bracket 58 to limit further counterclockwise rotation of the first and second platforms 20, 22.

Once the first platform 20 has reach the end of its angular travel, the second platform 22 can be rotated in relation of the first platform 20 in the clockwise direction, from the perspective of FIG. 2, about the hinge bracket 36.

Each restraint 70 is configured so that its respective strap 72 becomes fully tensioned as the second member 22 undergoes an angular displacement of slightly over 90 degrees in relation of the first member 20, to an orientation slightly inclined from the vertical. The tensioned strap 72, supported at its midpoint by the corresponding pole 74, acts as a stop that prevents further counterclockwise rotation of the second member 22 in relation to the first member 20.

At this point, the seating system 10 is configured in its rearward-facing configuration. The seating area is facing away from the cockpit of the vessel 12 and toward the swimming platform, with the first platform 20 providing a seating area for the user and the second platform 22 providing back support.

By opening both ways from the same starting point, the seating system 10 helps to maximize both the cockpit space and swim platform space of the vessel 10, without compromising the usable cockpit.

The seating system 10 extends out away from the vertical stored position either forward or aft, allowing use of the entire cockpit or transom platform of the vessel 10 when the seating system 10 is in the stored position. Current seats in the market fold out from a fixed bulkhead; open into the space that the user is occupying and extend into that space by about 20 inches; and open in only one direction. The seating system 10 thus can provide the overall advantage of space savings in both directions, i.e., when deployed in both the forward and rearward facing positions.

Also, it is believed that many current seats cannot face aft in applications with stern-mounted engines, because the seats would be would be too close to the engines.

Because the seating system 10 does not significantly consume cockpit space when open in the forward position, the aft bulkhead can be positioned more aft than otherwise would be possible, which in turn helps maximize the interior space. Thus, more features can provided in the cockpit than otherwise would be possible, while maintaining the same usable floor space.

The seating system 10 can be equipped with features such as fishing rod holders that can be used when the seat is in the stored position; and a cockpit table that can be used when the seating system 10 is in the open position.

The seating system 10 is described herein in connection with a waterborne vessel 12 for illustrative purposes only. The seating system 10 can be used in other applications, such as recreational vehicles and other ground-based motorized vessels or vehicles, and in applications that do not involve a moving vessel or vehicle.

I claim:

1. A seating system for a waterborne vessel, comprising:

a first platform;

a second platform coupled to the first platform and configured to rotate in relation to the first platform;

a mount configured to be mounted on the waterborne vessel;

a hinge, the hinge including:

a first arm mounted on the first platform, and a second arm mounted on the second platform and connected to the first arm, the second arm being rotatable in relation to the first arm;

an extension bracket connected to the first and second brackets and being rotatable in relation the first and second brackets, the extension bracket configured to be coupled to the mounting surface and to rotate in relation to the mounting surface, the extension bracket configured to extend and retract in response to the rotation of the first and second arms in relation to the mount, the extension bracket configured to limit a range of rotation of the first arm in relation to the mount and a range of rotation of the second arm in relation to the mount;

wherein:

the seating system is configured to move between a first position, a second position, and a third position, the second platform has a substantially horizontal orientation and the first platform is substantially upright when the seating system is in the first position, the first platform has a substantially horizontal orientation and the second platform is substantially upright when the seating system is in the second position, the first and second platforms each have a substantially vertical orientation when the seating system is in the third position.

2. The system of claim 1, wherein:

the second arm is configured to engage and rotate in relation to the mount when the seating system is in the first position; and the first arm is configured to engage and rotate in relation to the mount when the seating system is in the second position.

3. The system of claim 2, wherein:

the first arm is further configured to be disengaged from the mount when the seating system is in the first position; and the second arm is further configured to be disengaged from the mount when the seating system is in the second position.

4. The system of claim 2, further comprising:

a first pin mounted on the first arm and configured to be received in a first groove formed in the mount when the seating system is in the second position; and a second pin mounted on the second arm and configured to be received in a second groove formed in the mount when the seating system is in the first position.

5. The system of claim 4, wherein:

the first arm is further configured to engage and rotate in relation to the mount by way of the first pin; and the second arm is further configured to engage and rotate in relation to the mount by way of the second pin.

6. The system of claim 4, wherein:

the first pin is further configured to be received in the first groove when the seating system is in the third position, and the second pin is further configured to be received in the second groove when the seating system is in the third position.

7. The system of claim 1, wherein the extension bracket comprises a first member, and a second member coupled to the first member and configured to translate linearly in relation to the first member.

8. The system of claim 6, further comprising:

a third pin mounted on the first arm and configured to be received in the first groove when the seating system is in the second position; and a fourth pin mounted on the second arm and configured to be received in the second groove when the seating system is in the first position.

9. The system of claim 1, wherein:

the first platform is configured to form a backrest and the second platform is configured to form a seating area when the seating system is in the first position; and the second platform is configured to form another backrest and the first platform is configured to form another seating area when the seating system is in the second position.

10. The system of claim 9, wherein the backrest formed by the first platform faces a first direction, and the backrest formed by the second platform faces a second direction substantially opposite the second direction.

11. The system of claim 1, wherein the first and second platforms each comprise a frame, and padding mounted on the frame.

12. The system of claim 4, wherein:

the first pin is located proximate a first end of the first arm;

the second pin is located proximate a first end of the second arm; and the second arm is connected to the first arm at a location on the second arm proximate a second end of the second arm, and at a location on the first arm proximate a second end of the first arm.

13. The system of claim 2, further comprising a restraint comprising a flexible member configured to carry a tension force, wherein:

a first end of the flexible member is securely attached to the first platform;

a second end of the flexible member is securely attached to the second platform; and the flexible member is configured to limit a range of rotation of the second platform in relation to the first platform.

14. The system of claim 13, wherein the restraint further comprises a rigid member configured to support the flexible member, and to further limit the range of rotation of the second platform in relation to the first platform when the seating system is in the first and second positions of the seating system.

15. The system of claim 2, wherein:

the hinge is a first hinge;

the system further comprises a second hinge;

the first arm of the first hinge is mounted on a first side of the first platform;

the second arm of the first hinge is mounted on a first side of the second platform;

the first arm of the second hinge is mounted on a second side of the first platform; and the second arm of the second hinge is mounted on a second side of the second platform.

16. The system of claim 2, wherein:

at least one of the first and second arms has a slot formed therein;

at least one of the first and second arms comprises a pin configured to be received in the slot of the other of the first and second arms; and the pin is further configured to guide the first and second arms during relative movement of the first and second arms, and to limit a range of rotation of the first and second arms in relation to each other.

* * * * *